United States Patent [19]

Oberhoffner et al.

[11] 4,363,548

[45] Dec. 14, 1982

[54] ARRANGEMENT FOR INTRODUCING BAND LIGHT-SENSITIVE MATERIAL INTO DEVELOPING DEVICE AND THE DEVELOPING DEVICE PROVIDED THEREWITH

[75] Inventors: Gerhard Oberhoffner; Horst Köninger; Alfons Kastl, all of Munich, Fed. Rep. of Germany

[73] Assignee: Agfa-Gevaert AG, Leverkusen, Fed. Rep. of Germany

[21] Appl. No.: 291,931

[22] Filed: Aug. 11, 1981

[30] Foreign Application Priority Data

Aug. 12, 1980 [DE] Fed. Rep. of Germany ..... 3030428

[51] Int. Cl.[3] ..... G03D 3/13

[52] U.S. Cl. ..... 354/298; 354/310; 354/321

[58] Field of Search ..... 354/298, 310, 311, 312, 354/313, 314, 316, 319, 320, 321

[56] References Cited

U.S. PATENT DOCUMENTS

| | | | |
|---|---|---|---|
| 3,195,438 | 7/1965 | Woodcock | 354/310 |
| 4,164,371 | 8/1979 | Viehrig et al. | 354/312 |
| 4,218,123 | 8/1980 | Viehrig et al. | 354/310 |

*Primary Examiner*—L. T. Hix
*Assistant Examiner*—Alan Mathews
*Attorney, Agent, or Firm*—Michael J. Striker

[57] ABSTRACT

An arrangement for introducing a band light-sensitive material in daylight from cassettes into a developing device has a receiving part located on a developing device and light-tightly receiving a guide part of cassettes, at least one separating element subdividing the interior of the receiving part into at least two compartments so that a wide cassette can be received into the receiving part in the absence of the separating element or one or two narrow cassettes can be received into one or two compartments of the subdivided receiving part, and a closing element provided in each of the compartments and independently acting for light-tightly closing the respective one of the compartments.

14 Claims, 8 Drawing Figures

ARRANGEMENT FOR INTRODUCING BAND LIGHT-SENSITIVE MATERIAL INTO DEVELOPING DEVICE AND THE DEVELOPING DEVICE PROVIDED THEREWITH

BACKGROUND OF THE INVENTION

The present invention relates to an arrangement for introducing a band light-sensitive material in daylight from cassettes having a guide part, into a treatment station of a developing device.

Arrangements of the above-mentioned general type are known in the art. The known arrangement includes a receiving element arranged on the developing device and light-tightly receiving a guide part of a cassette. A known developing device is designed so that it can provide for treatment of a conventional roll film of a predetermined dimension, namely with a width of 105 mm. Recently the X-ray medicine started to utilize movies on 35 mm films, particularly for heart examinations. Also other film widths found today their application in X-ray examinations, for example 100, 90, 70 and 60 mm films. These films can be treated without additional steps in the same developing device. It is to be understood that when a film with a small width is introduced into the developing device, the latter is not charged to its full capacity. Taking this into consideration, it is advisable to treat in the developing device simultaneously two or more films. However, in this case the problem of light tightness of the receiving element arises, when only one cassette is introduced or one of the cassettes must be exchanged.

SUMMARY OF THE INVENTION

Accordingly, it is an object of the present invention to provide an arrangement for introducing a band light-sensitive material into a developing device, which avoids the disadvantages of the prior art.

More particularly, it is an object of the present invention to provide an arrangement for introducing a band light-sensitive material in daylight from cassettes into a developing device, which allows introduction of two or more cassettes of a smaller width into the developing device and withdrawal of the same without affecting the light tightness of the developing device.

In keeping with these objects and with others which will become apparent hereinafter, one feature of the present invention resides, briefly stated, in an arrangement for introducing a band light-sensitive material in daylight from cassettes with a guide part into a treatment station of a developing device, in which at least one separating element is insertable into the interior of a receiving element provided in a developing device so as to subdivide the interior of the receiving element into at least two compartments, whereby in the absence of the separating element a greater cassette can be inserted into the interior of the receiving part, whereas in the presence of the separating element two smaller cassettes can be inserted into the interior of the receiving part each in the respective one of the compartments, and a closing element is provided for each of the compartments so that it opens in response to the insertion of the guide part of a respective one of the cassettes into the interior of the receiving part.

When the arrangement is designed in accordance with the present invention it makes possible at least double film treatment in daylight so as to provide full charge of the developing device. The introduction and treatment of the parallel running films is independent from one another and rearrangement from the single film treatment to the double film treatment or multiple film treatment can be easily actuated by a single handle.

In accordance with another feature of the present invention, the closing elements are arranged to obstruct or to release a portion of the transport path during its transportation from the cassette into the developing device through an opening and with the aid of a roller pair provided in the developing device.

In accordance with still another feature of the present invention the closing elements are urged toward their closed position, and more particularly spring elements are provided for urging the closing elements to the closed position.

Actuating elements may be provided on the closing elements so as to cooperate with the guide part of the respective cassette and thereby displace the closing element to its open position in response to the insertion of the guide part of the respective cassette into the receiving element.

In accordance with an advantageous feature of the present invention, the actuating elements may be formed as wedge members each protruding into the interior of the receiving element in the closed position of the closing elements. The inclined faces of the wedge members cooperate with the edges of the guide part of the cassette.

Light sealing means may be provided for sealing the closing element relative to the developing device. The light sealing means may be formed as cooperating formations provided on each of the closing elements and a fixed part of the developing device.

In accordance with a further feature of the present invention, the light sealing means are formed as abutting edges of two wing members formed in each of the closing elements, wherein the wing members are displaceable and openable by the cassettes in a gate-like member in response to the insertion of the guide part of the cassette into the receiving element.

Each of the closing elements may also be formed as a plate displaceable in response to rotation of a friction wheel which contacts the guide part of the cassette during movement of the latter into and out of the receiving part. The closing element may be connected with the friction wheel by a rope.

Finally, the optical sensing means may be provided between the closing element and the roller pair of the developing device and operative for controlling the dosing device. The optical sensing means may include a light emitting element arranged at one side of the material and a light receiving element arranged at the other side of the material opposite to the light emitting element.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
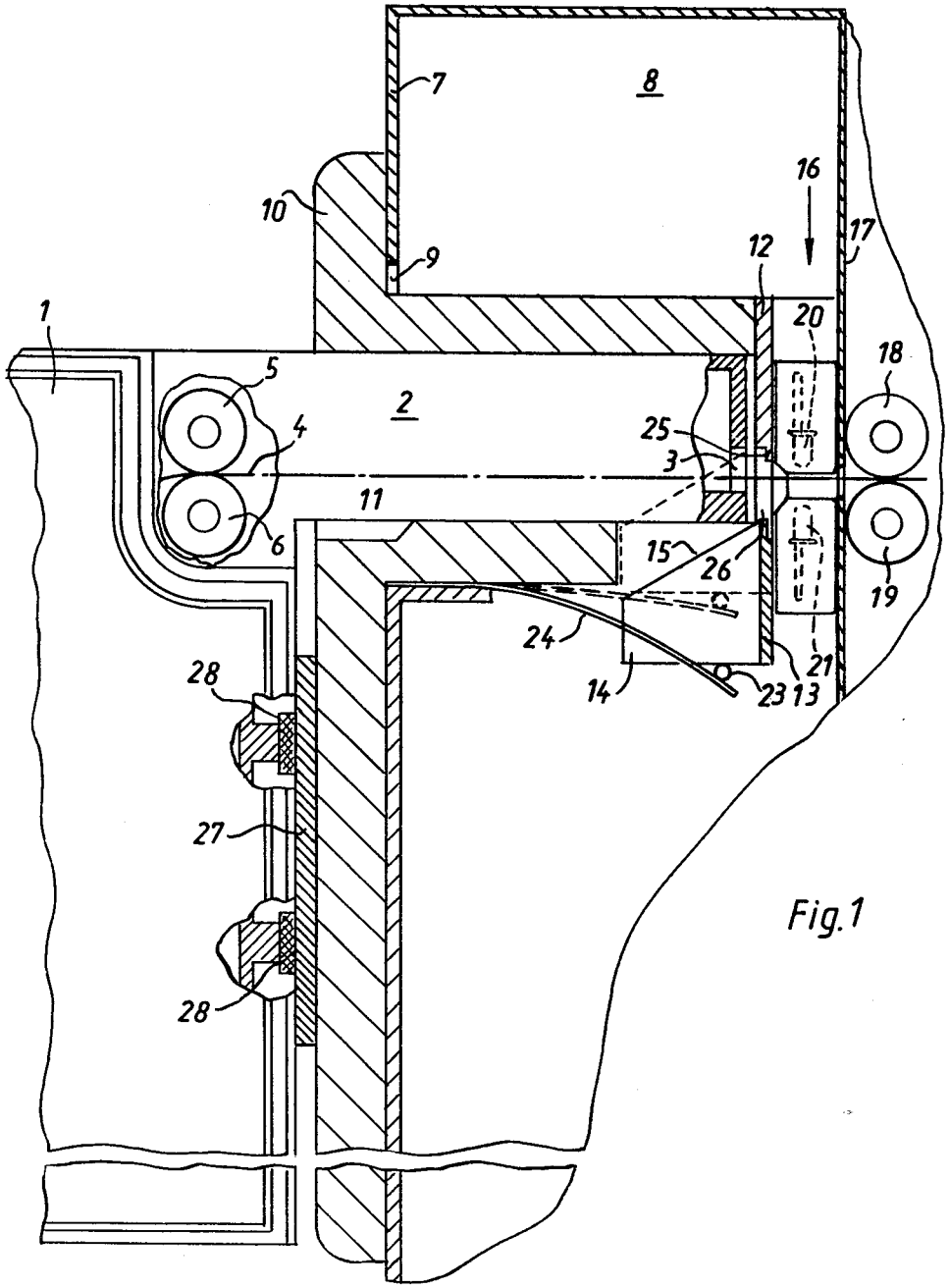
FIG. 1 is a view showing a section of an arrangement for introducing a light sensitive material from a cassette into a developing device, in accordance with one embodiment of the invention.

An arrangement for introducing a light-sensitive material in daylight from a cassette into a developing device is shown in FIG. 1, wherein a film cassette is identified by reference numeral 1 and provided at its upper side with an elongated guide part 2. The guide part 2 has an outer slot 3 for a film 4, and the latter is pulled from the roll by a transport roller pair 5 and 6.

A developing device is identified by reference numeral 8 and has a housing 7 with an opening 9. A receiving insert 10 is inserted into the opening 9 of the housing 7. The receiving insert 10 has a rectangular receiving passage 11 which serves for receiving the guide part 2 of the cassette 1. The receiving passage 11 has a length which is approximately equal to the length of the guide part 2 and is closed by two-part closing walls or elements 12 and 13. The closing element 12 is fixedly mounted on the developing device, whereas the closing element 13 is movable relative to the same.

The closing element 13 is movable normal to the plane of the film and has a width which is greater than the width of the film 4. Moreover, two wedge pieces 14 are provided on the closing element 13 and extend toward the receiving side of the cassette. The wedge pieces 14 of which only one is shown in FIG. 1, have a stopping face 15 which cooperates with the horizontal lower front edge of the guide part 2 of the cassette 1. A round piece 23 is mounted on the wedge piece 14 and more particularly, its side which is opposite to the stopping face 15. A flat spring 24 abuts against the round piece 23. The other end of the flat spring 24 is located on the housing 7 of the developing device.

The flat spring 24 urges the wedge piece 14 with the closing element 13 to a position which is shown in dotted lines in FIG. 1. In this position, the closing element 13 contacts the fixed element 12. In order to provide for improved light-tightness, the closing element 12 has a projection 25, whereas the closing element 13 is provided with a complementary projection 26. In the closed position the projections 25 and 26 of the closing elements 12 and 13 interengage with one another so as to provide for light tightness.

Figure 1A:
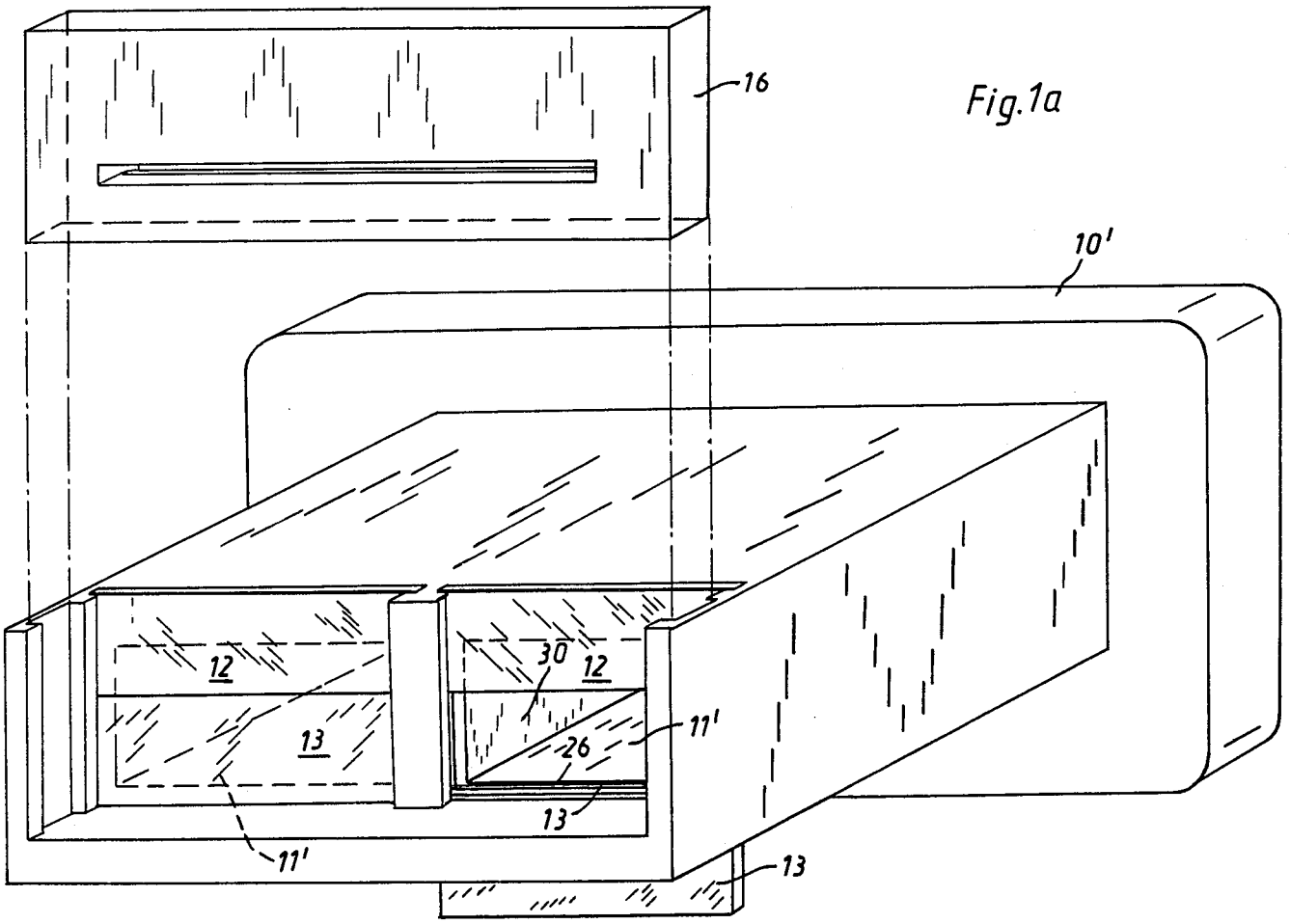
FIG. 1*a* is a perspective view of the arrangement shown in FIG. 1.

As shown in FIG. 1*a*, the receiving passage 11 is subdivided by at least one separating element 30 into at least two compartments 11'. As mentioned above, the closing element 13 is composed of two parts each carrying one wedge piece 14 and arranged to close a respective one of said compartments individually. The arrangement allows the introduction of cassettes of different dimensions, as will be explained hereinbelow.

An optical sensing device 16 is arranged behind the closing element 12, as considered in the insertion direction of the cassette. A further housing wall 17 and inlet roller pair 18 and 19 for introducing the film 4 into the first treatment tank are provided therebehind. The optical sensing device has an upper line of light diodes 20 located at the upper side of the film running plane, and a lower line of photoreceivers 21 located therebelow. The operation of the optical sensing device will be explained hereinbelow. A gap 22 is provided in the housing wall 17 at the height of the film running plane.

A metal plate 27 is arranged at the front side of the receiving insert 10. The metal plate 27 is located opposite to magnets 28 which are arranged in the cassette 1. This contributes to the firm hold of the cassette on the developing device. It is to be understood that the magnets can be provided on the receiving insert 10, whereas the metal plate can be provided on the cassette.

Figure 2:
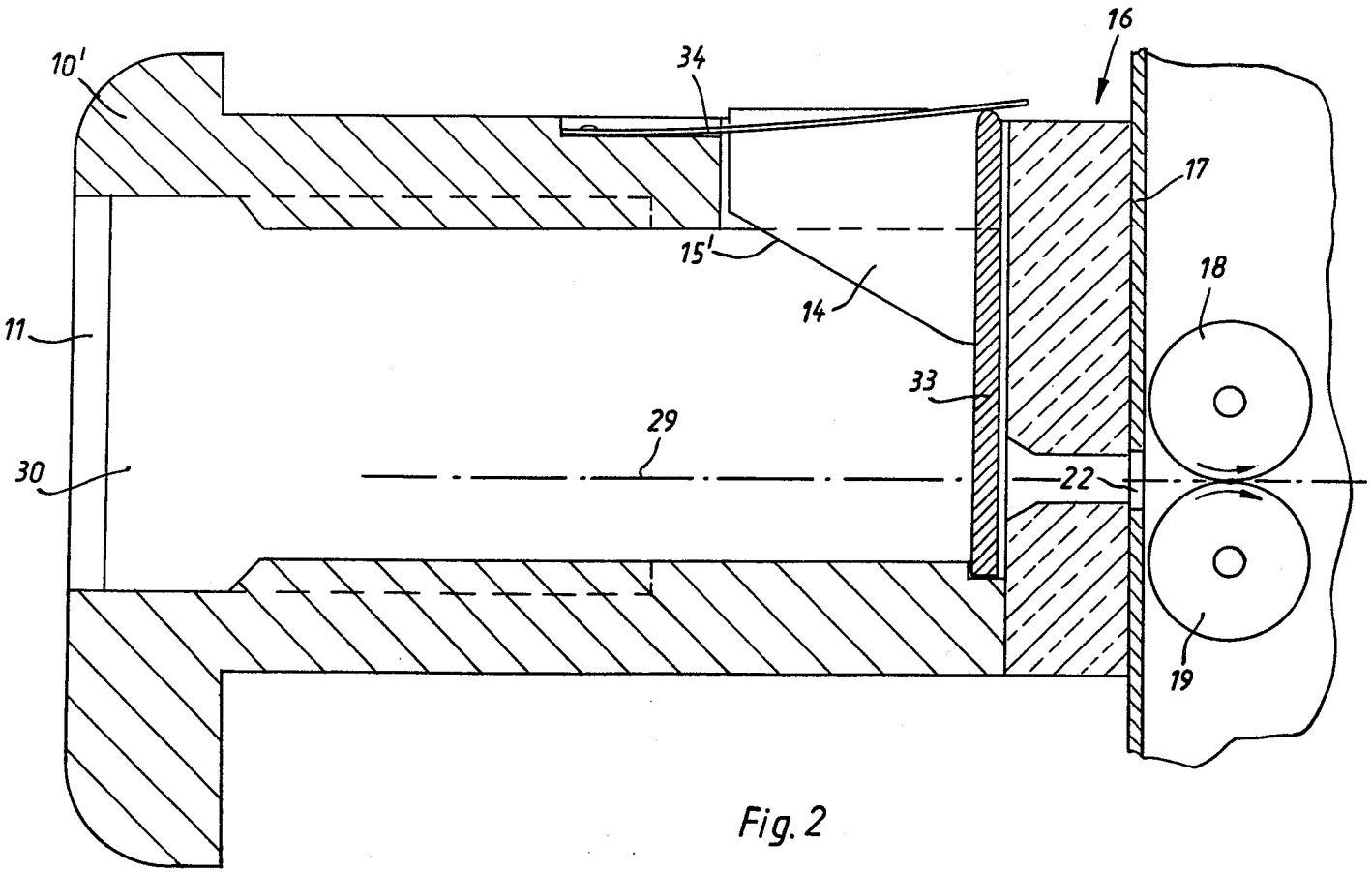
FIG. 2 is a view showing a section of the inventive arrangement in accordance with a second embodiment of the present invention.

FIG. 2 shows another possibility for operation of the closing element. The arrangement shown in this Figure has a modified receiving insert 10'. The separating element 30 is first introduced into the receiving passage 11 of the receiving insert 10'. It subdivides the receiving passage 11 for a wide cassette into two compartments for cassettes with smaller film widths. In this arrangement there is no movable closing element 12, and the entire receiving passage 11 is closed by a greater closing element 33. A wedge piece 14' is arranged at the upper side of the closing element 33 and the flat spring 34 is also provided at this location.

A stopping face 15' cooperates with the horizontal upper edge of the guide part 2 of the cassette 1. Since a film running plane 29 is located close above the bottom of the receiving passage 11 of the receiving insert 10', the fixed closing element is not needed in this embodiment because the stroke of the movable closing element 33 is sufficient for releasing the outlet opening 3 in the cassette 1.

Figure 3:
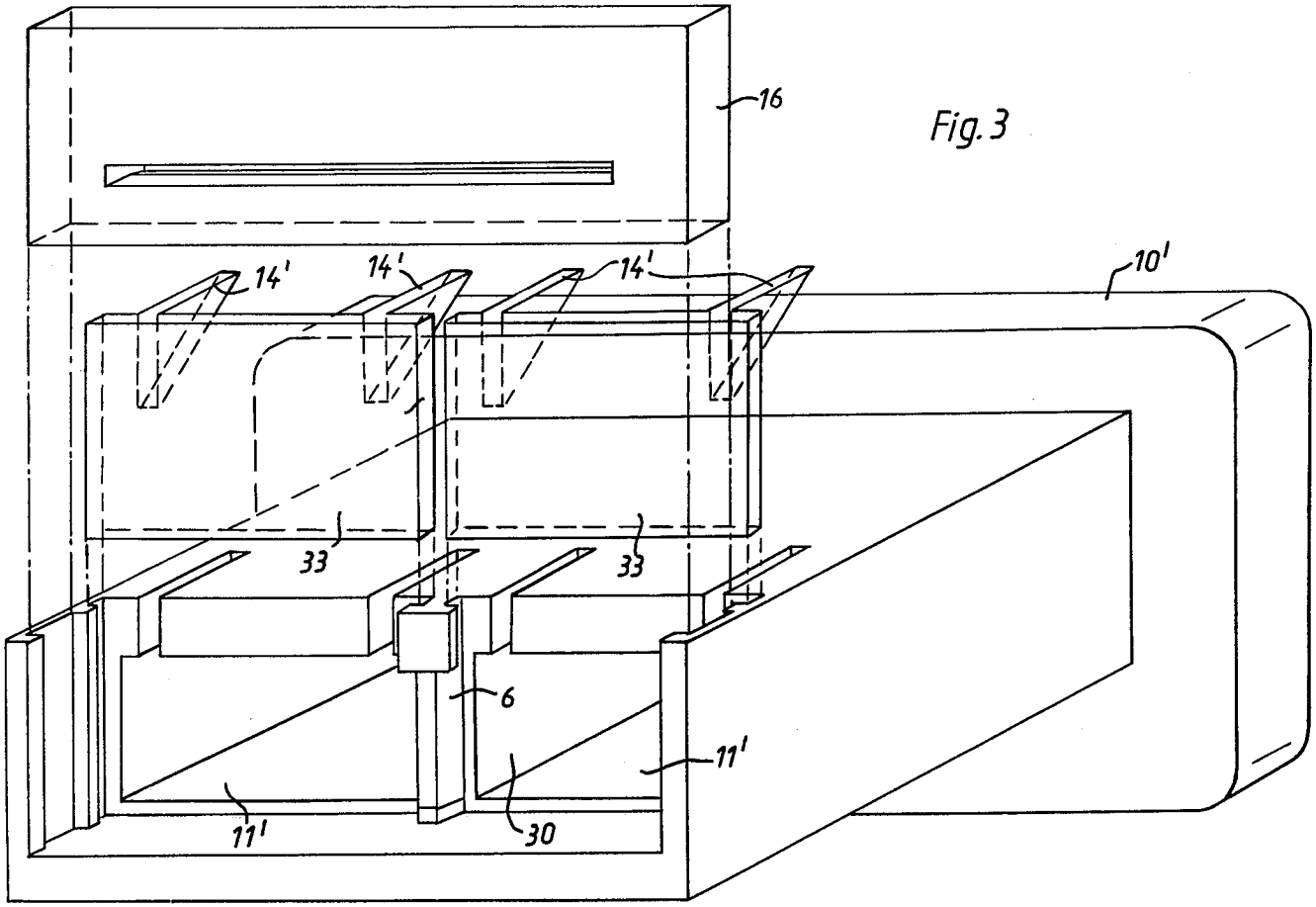
FIG. 3 is a perspective view of the arrangement shown in FIG. 2.

As can be seen from FIG. 3, the arrangement allows the introduction of cassettes with different dimensions. The receiving passage 11 of the insert 10' is subdivided by the separating element 30. Moreover, the closing element 33 composed of two parts each carrying the separate wedge piece 14' as well as the sensing device 16 can be seen in this Figure.

In operation, it must first be determined whether a cassette of greater or smaller width is to be treated. In the latter case, the separating element 30 is introduced into the receiving passage 11. Then one or two cassettes can be inserted respectively into one or two compartments of the subdivided receiving passage 11. During insertion of the cassette, the lower or upper edges thereof abut against the stopping faces 15 or 15' of the respective wedge pieces 14 or 14' and displace the latter together with the closing elements 13 or 33 to the open position. Thereby one or two compartments of the receiving passage 11 open, and the film by actuation of the roller pair 5 and 6 in the cassette 1 can be inserted past the sensing device 16 and the opening 22 in the housing wall 17 into the roller pair 18 and 19.

The roller pair 18 and 19 carry out the further transport of the film 4 into the developing device. The light diodes 20 and the photoreceiver 21 of the optical device 16 are so arranged that they can sense which film width or film widths are introduced into the developing device. In dependence upon the sensed characteristics, the sensing device produces signals which are supplied to a dosing device for individual treatment tanks.

More particularly, the sensing device senses the width of one cassette introduced in the receiving passage 11 or the widths of the cassettes with smaller widths introduced into the respective compartments of the receiving passage 11 subdivided by the separating element 30. In the latter case, the widths of the cassettes are added. With the width of the wider cassette or the sum of the widths of narrower cassettes and a given film transport speed, the optical device determines a film area to be developed and produces a signal which actuates the dosing device so that the latter supplies a corresponding quantity of the treatment medium.

Figure 4:
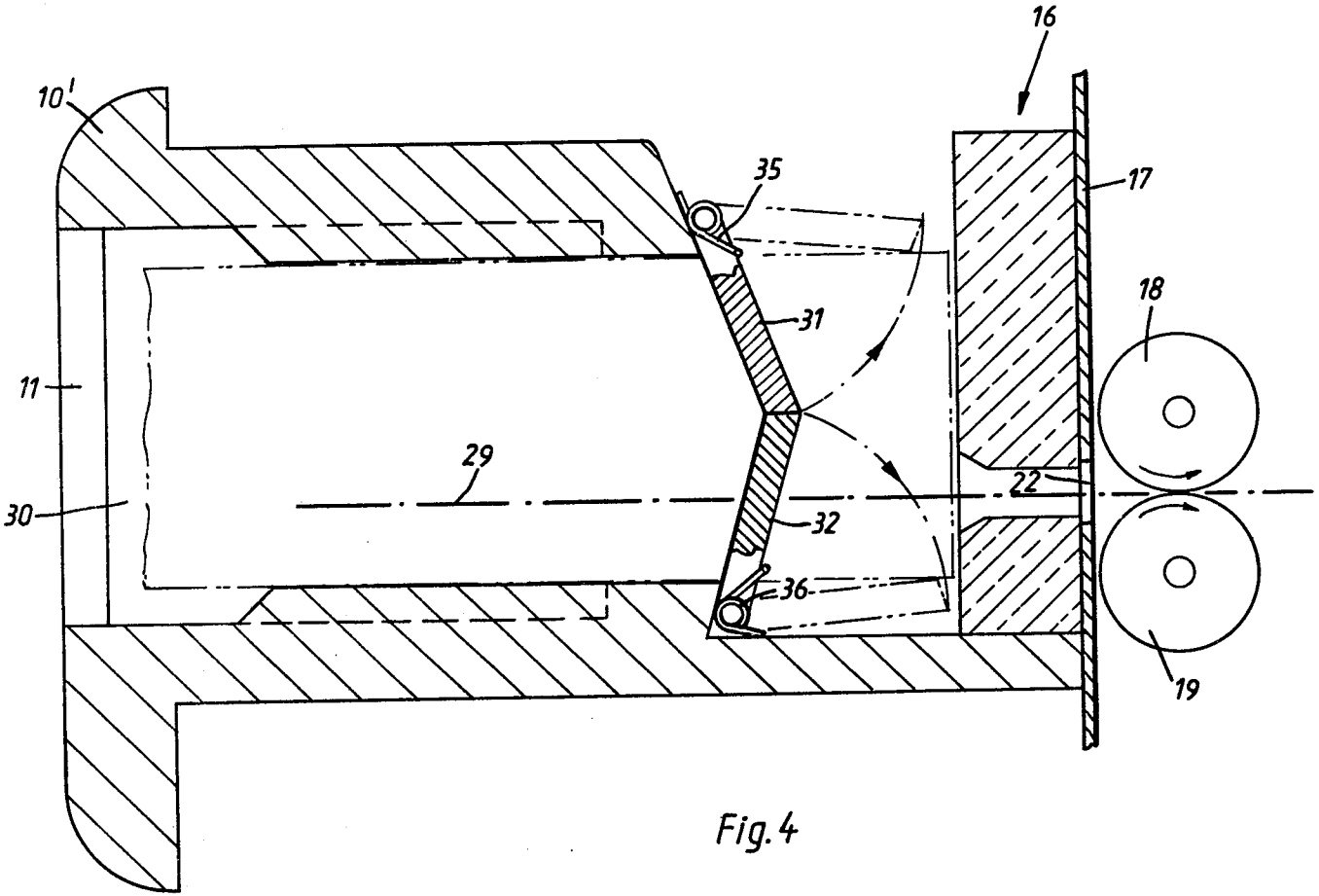
FIG. 4 is a view showing a section of the inventive arrangement in accordance with a third embodiment of the invention.

The arrangement shown in FIG. 4 has a closing element which is further modified. The closing element has upper and lower flaps 31 and 32 each provided with a spiral spring 35 or 36, respectively. The flaps 31 and 32 cooperate with one another under the action of these springs. When the guide part of the cassette 1 is inserted into the receiving passage 11 of the receiving element 10', the upper and lower edges of the same displace the flaps 31 and 32 in a gate-like manner from one another to positions shown in dotted lines. The contact faces of the flaps 31 and 32 are designed so that the closed position they guarantee a light-tight overlapping of the receiving passage 11. In the arrangements shown in FIGS. 1–4, the closing of the closing elements in carried out under the action of the spring 14, 35, or 35 and 36.

Figure 4A:
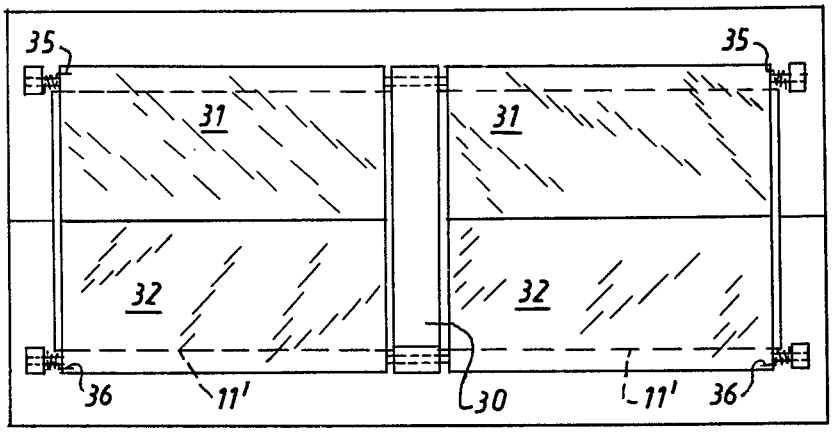
FIG. 4*a* is a front view of a closing element of the arrangement shown in FIG. 4.

As can be seen from FIG. 4*a*, each of the flaps 31 and 32 is composed of two parts each arranged for closing a respective compartment of the receiving passage 11 subdivided by the separating element 30.

Figure 5A:
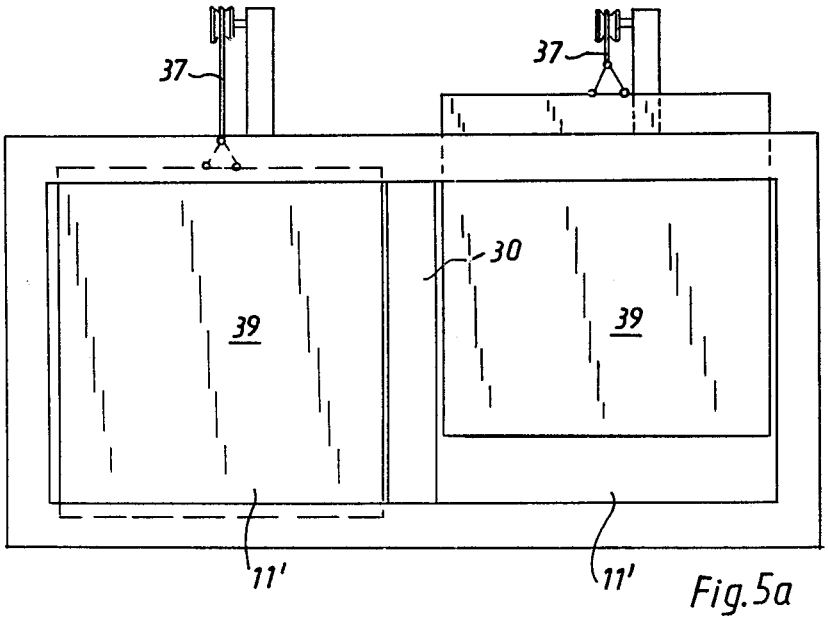
FIG. 5*a* is a front view of a closing element of the arrangement shown in FIG. 5.
Figure 5:
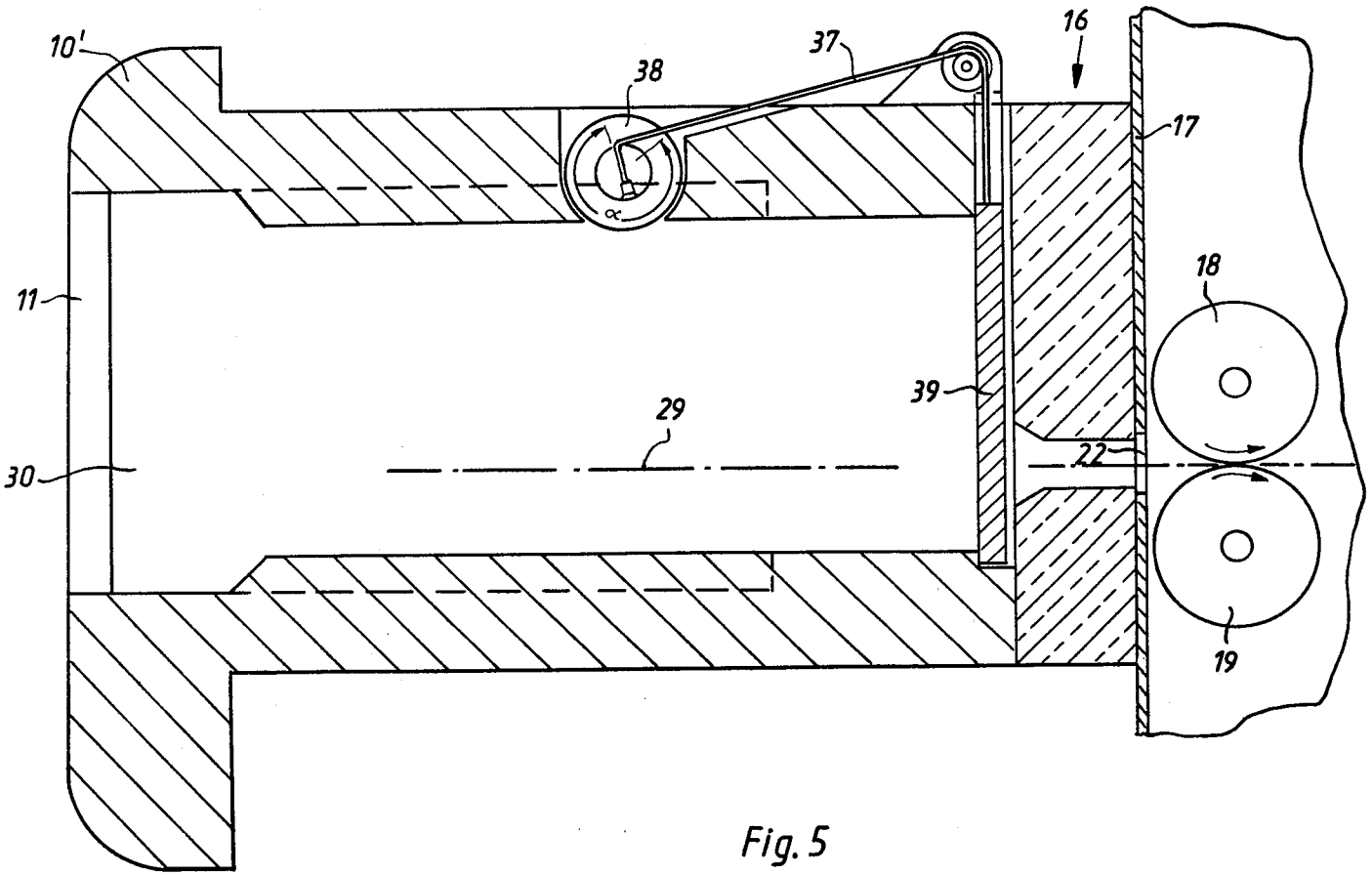
FIG. 5 is a view showing a section of the arrangement in accordance with a fourth embodiment of the invention.

The arrangement shown in FIG. 5 has a closing element 39 which is connected with a rope or cable 37. The cable 37 is in turn connected with a friction wheel 38 arranged at the lower side of the receiving insert 10' and extending into the displacement path of the cassette 1. When the cassette 1 is introduced into the receiving passage 11 the outer surface of the guide part 2 of the cassette rubs against the wheel 38 and rotates the same in clockwise direction. Thereby, the cable 36 is wound onto the axle of the wheel 38 and pulls the closing element 33 so as to lift the latter from the film running plane 29. When the cassette is pulled out of the receiving passage 11 of the receiving insert 10', the friction wheel 38 rotates in the opposite direction and thereby the closing elements 33 lowers to overlap the receiving passage.

As can be seen from FIG. 5*a*, the closing element 39 is composed of two parts each arranged for closing a respective compartment of the receiving passage 11 subdivided by the separating element 30.

It is to be understood that the receiving passage 11 may be subdivided into more than two compartments by introducing into the same more than one separating element. Thereby more than two cassettes can be treated simultaneously or separately in the arrangement.

It will be understood that each of the elements described above, or two or more together, may also find a useful application in other types of constructions differing from the types described above.

While the invention has been illustrated and described as embodied in an arrangement for introducing a band light-sensitive material in daylight from cassettes into a developing device, it is not intended to be limited to the details shown, since various modifications and structural changes may be made without departing in any way from the spirit of the present invention.

We claim:

1. An arrangement for introducing a band light-sensitive material in daylight from cassettes having a guide part into a treatment station of a developing device, comprising a receiving part arranged to be located on a developing device and to light-tightly receive a guide part of cassettes; means for subdividing the interior of said receiving part and including at least one separating element insertable into the interior of said receiving part so as to form at least two compartments therein, whereby in the absence of said separating element a greater cassette can be inserted into the interior of said receiving part, whereas in the presence of said separating element two smaller cassettes can be inserted into the interior of said receiving part each in the respective one of said compartments thereof; and means for light-tightly closing the interior of the developing device from the interior of said receiving part and including a closing element provided in each of said compartments at its end adjacent to the developing device and opening in response to insertion of the guide part of a respective one of the cassettes into the interior of said receiving part.

2. An arrangement as defined in claim 1, wherein the developing device has an opening and a roller pair for transporting the material through the opening to a first treating station along a predetermined transport path from the cassette, said receiving part defining a portion of said transport path, each of said closing elements being arranged to release said portion of said transport path in an open condition of said closing elements.

3. An arrangement as defined in claim 1, wherein each of said closing elements is movable between open and closed positions; and further comprising means for urging said closing elements to said closed position.

4. An arrangement as defined in claim 3, wherein said urging means for urging said closing elements to said closed position includes a spring provided for each of said closing elements.

5. An arrangement as defined in claim 4; and further comprising actuating element provided on each of said closing element and cooperating with an edge of the guide part a respective one of the cassettes so that upon insertion of the guide part of the respective cassette the latter moves the respective one of said closing elements to said open position against the action of a respective one of said springs.

6. An arrangement as defined in claim 5, wherein each of said actuating elements is formed as a wedge member having an inclined stopping face, each of said wedge members being arranged so that in the closed positions of said closing elements said stopping faces extend into the interior of said receiving element.

7. An arrangement as defined in claim 2, wherein each of said closing element is movable between open and closed positions, the developing device having a fixed part; and further comprising light-sealing means for sealing each of said closing elements relative to the fixed part of the developing device in said closed position of said closing elements.

8. An arrangement as defined in claim 7, wherein the developing device has a first formation, each of said closing elements having a second formation which light-tightly cooperate with the first formation in said closed position of said closing elements so as to form said light-sealing means.

9. An arrangement as defined in claim 7, wherein each of said closing elements is formed by two wing members which are movable relative to and light-tightly abut against one another in said closed position so as to form said light-sealing means, said wing members being displaceable and openable by the respective cassette in a gate-like manner in response to the insertion of the guide part of the cassette into said receiving element.

10. An arrangement as defined in claim 1; and further comprising a friction wheel arranged to rotate under the action of frictional contact with the guide part of the respective cassette upon insertion and withdrawal of the same, each of the closing elements being connected with said friction wheel and movable between open and closed position in response to the rotation of said friction wheel.

11. An arrangement as defined in claim 10; and further comprising means for connecting each of said closing elements with said friction wheel and including a rope.

12. An arrangement as defined in claim 1, wherein developing station has a dosing device and a roller pair for transporting the material; and further comprising optical sensing means arranged between said closing elements and the roller pair and operative for controlling the dosing device.

13. An arrangement as defined in claim 12, wherein said optical sensing means includes a light-emitting element arranged at one side of the material and a light-receiving element arranged at the other side of the material opposite to said light-emitting element.

14. A developing device for developing a band light-sensitive material supplied in daylight introduced from cassettes having a guide part, comprising a developing tank; a receiving part arranged on said developing tank and light-tightly receiving a guide part of cassettes; means for subdividing the interior of said receiving part and including at least one separating element insertable into the interior of said receiving element so as to form at least two compartments therein, whereby in the absence of said separating element a greater cassette can be inserted into the interior of said receiving part, wheras in the presence of said separating element two smaller cassettes can be inserted into the interior of said receiving part each in the respective one of said compartments thereof; and means for light-tightly closing the interior of said developing tank from the interior of said receiving part and including a closing element provided in each of said compartments at its end adjacent to said developing tank and opening in response to insertion of the guide part of a respective one of the cassettes into the interior of said receiving part.

* * * * *